US008978901B2

(12) United States Patent
Hogeback

(10) Patent No.: US 8,978,901 B2
(45) Date of Patent: Mar. 17, 2015

(54) ILLUMINATED BOTTLE HOLDER

(76) Inventor: Darryl Hogeback, Denver, CO (US)

( * ) Notice: Subject to any disclaimer, the term of this patent is extended or adjusted under 35 U.S.C. 154(b) by 132 days.

(21) Appl. No.: 13/402,382

(22) Filed: Feb. 22, 2012

(65) Prior Publication Data

US 2012/0325759 A1 Dec. 27, 2012

Related U.S. Application Data

(60) Provisional application No. 61/445,906, filed on Feb. 23, 2011.

(51) Int. Cl.
*A47B 73/00* (2006.01)

(52) U.S. Cl.
USPC ..... 211/74; 362/101

(58) Field of Classification Search
CPC .... A47B 73/00; A47B 73/002; A47B 73/006; A47B 81/007; A47F 7/283; A47F 7/28; A47F 3/001; A47G 23/0241; A47G 23/0309; A47G 2019/2238; F21V 33/0036
USPC ..... 211/74, 75, 71.01, 26; 362/217.12, 362/217.13, 640–659, 249.06, 368, 432, 362/101, 457, 458; 248/309.1, 314, 105, 248/311.2, 346.03
See application file for complete search history.

(56) References Cited

U.S. PATENT DOCUMENTS 2,102,982 A * 12/1937 Taylor ..... 211/1.53
2,521,449 A * 9/1950 Cossa ..... 222/192
2,888,657 A * 5/1959 Green ..... 439/242
4,270,662 A * 6/1981 Gonzalez ..... 211/74
4,795,038 A * 1/1989 Johnson ..... 211/74
4,887,726 A * 12/1989 Cizaire ..... 211/74
5,904,257 A * 5/1999 Marmet et al. ..... 211/75
6,991,117 B2 * 1/2006 McCain ..... 211/75
7,004,336 B2 * 2/2006 Dagan ..... 211/181.1
7,322,482 B2 * 1/2008 Caradonna ..... 211/74
7,350,647 B2 * 4/2008 Haller et al. ..... 211/75
7,465,058 B1 * 12/2008 Lopez ..... 362/154
2003/0015487 A1 * 1/2003 Henderson et al. ..... 211/74
2004/0104187 A1 * 6/2004 McCain ..... 211/75
2006/0043035 A1 * 3/2006 Madsen ..... 211/74
2006/0065612 A1 * 3/2006 Gonneville ..... 211/75
2006/0096936 A1 * 5/2006 McCain ..... 211/74
2006/0126325 A1 * 6/2006 Lefebvre et al. ..... 362/217
2006/0163181 A1 * 7/2006 Caradonna ..... 211/74
2007/0158284 A1 * 7/2007 Felder ..... 211/74
2007/0206372 A1 * 9/2007 Casillas ..... 362/101
2008/0035515 A1 * 2/2008 Dikopf ..... 206/457
2009/0152221 A1 * 6/2009 Hynes ..... 211/74
2009/0152223 A1 * 6/2009 McCain ..... 211/74

(Continued)

*Primary Examiner* — Patrick Hawn
(74) *Attorney, Agent, or Firm* — Russell T. Manning; Marsh Fischmann & Breyfogle LLP

(57) ABSTRACT

Systems and methods are herein disclosed for holding a bottle (e.g., a wine bottle) at an angle that facilitates viewing the wine bottle label. The bottle holder may also include illuminating elements for casting viewing light upon the label of a wine bottle and to enhance viewing of the wine bottle shape, texture, and color. Such illuminating elements can be oriented upwards or downwards in order to cast last on the wine bottle above or below the illuminating elements. The bottle holder has at least two components: an elongated support member (bottle support member) and a wall mount. The wall mount can be fixed to a wall and the bottle support member can be secured to the wall mount. The wall mount and bottle support member can also include wiring and electrical connections to enable use of illuminating elements on the bottle support member.

8 Claims, 11 Drawing Sheets

(56) References Cited

U.S. PATENT DOCUMENTS

2011/0090682 A1* 4/2011 Zheng et al. ..... 362/218
2011/0132853 A1* 6/2011 Drobot et al. ..... 211/42
2011/0309220 A1* 12/2011 Collini ..... 248/311.2
2012/0085721 A1* 4/2012 Michael et al. ..... 211/103
2012/0273444 A1* 11/2012 McCain ..... 211/75

* cited by examiner

ILLUMINATED BOTTLE HOLDER

CROSS REFERENCE

This application claims priority under 35 USC §119 to U.S. Provisional Application No. 61/445,906 filed Feb. 23, 2011, the entire contents of which are incorporated herein by reference.

FIELD OF INVENTION

This disclosure describes systems and methods for holding, displaying, and illuminating wine bottles.

BACKGROUND OF THE INVENTION

Conventionally, wine racks are used in wine cellars or other wine storage areas to store numerous bottles of wine in a desired area. In such conventional wine racks, the bottles of wine are supported along the length of the bottle within a grid of generally rectangular cavities stacked upon and next to each other, each rectangular cavity typically formed by pairs of parallel wood supports held in position by front and rear frame structures. These wine racks are generally solidly built wooden structures, and the cavities are capable of storing one or more bottles of wine vertically stacked on top of each other.

Also, in this example of a conventional wine rack, the wine rack is typically configured such that user places a bottle of wine longitudinally within one of the rectangular cavities such that when the rack is full of wine bottles, only the top ends (i.e., where the foil is wrapped around the top end) of the wine bottles are generally visible when viewing the wine rack—and the labels on the wine bottle are not generally visible by the user. As such, in order to determine which type of wine (e.g., varietals/grape type, winery name, vintage/year, etc.) is stored in a particular cavity of such a wine rack, the user may need to remove the bottle from the wine rack in order to view the label on the bottle.

Wine racks typically make viewing wine bottles difficult. Lighting is often poor and/or blocked by supporting elements of the rack. Bottle often must be removed or moved to view the labels.

SUMMARY OF THE INVENTION

A bottle holder and methods of using the bottle holder are herein disclosed. The bottle holder facilitates viewing and illumination of one or more bottles (e.g., wine bottles). The bottle holder is arranged so that a bottle can be viewed without removing the bottle from the holder. Illumination may be included to further enhance viewing of the bottle. Illumination can be provided via illuminating elements oriented upwards or downwards in order to cast light on the bottom or top of a bottle, respectively. The bottle holder has at least two major components: an elongated support member (bottle support member) and a wall mount. The wall mount can be fixed to a wall and the bottle support member can be secured to the wall mount. For instance, threaded elements (e.g., screws) can be used to selectively secure the bottle support member to the wall mount. Such means for securing the bottle support member to the wall mount facilitates attaching the wall mounts to a wall during construction and subsequently attaching the outwardly extending bottle support members. The separate wall mount and support members also enable the bottle support members to be reoriented within a given wall mount to account for installation misalignment with a wall mount. The wall mount and bottle support member can also include wiring and electrical connections to power the illuminating elements.

In one aspect, a wine holding and displaying system includes a wall mount and an elongated support member. The wall mount is adapted for fixed interconnection to a wall, and includes a surface with a recessed socket formed therein. The elongated support member includes an attachment end and a free end where the attachment end is adapted for conformal receipt within at least a portion of the socket. An elongated body extends between the ends and includes at least a first support for cradling and supporting a wine bottle. The bottle support element can be releaseably connected to the elongated support member. In one arrangement, the support may substantially align an axis of the wine bottle (passing through its base and neck) with a long axis of the elongated body.

The wine bottle holder may further include a connector for selectively maintaining the attachment end within the socket. The connector may include first and second threaded elements. Such threaded elements may overly first and second tabs attached to the attachment end of the elongated support member.

The elongated support member can have first and second portions that are angled relative to each other to permit, for example, better viewing of a wine bottle supported thereon. Further the elongated support member may include an illuminating element. In such an arrangement the elongated support member may include electrical contacts and the socket of the wall mount can have mating electrical contacts. Accordingly, the illuminating element can receive electrical power from the wall mount when the elongated support member is disposed within the socket.

Another aspect discloses a wine holding and displaying system having a wall mount, an elongated support member, and an illuminating element. The wall mount has first and second electrical contacts. The elongated support member has a free end and an attachment end having electrical contacts that mate with the electrical contacts in the wall mount. An illuminating element is connected to the elongated support member (or embedded within the elongated support member). This illuminating element is electrically connected to the electrical contacts of the wall mount when the elongated support member is connected to the wall mount. The illuminating element can illuminate a wine bottle held in the elongated support member or a wine bottle being held in an elongated support member below the elongated support member where the illuminating element is located. The wall mount can include a socket for receiving an attachment end of the elongated support member.

In another aspect, a wine holding and displaying system has a wall mount including a receiving socket, an elongated support member, first and second threaded elements, a first threaded receiving hole, a second threaded receiving hole, and optionally an illuminating element. The elongated support member has a free end and an attachment end having first and second outwardly extending tabs. The attachment end and the first and second outwardly extending tabs are sized to engage with the socket of the wall mount where at least a portion of the tabs are disposed within the threaded receiving holes. The first and second threaded elements may be treaded into the receiving holes to selectively secure the elongated support member to the wall mount. That is, the first threaded hole overlays at least a portion of the socket that receives at least a portion of the first outwardly extending tab and the second threaded hole overlays at least a portion of the socket that receives at least a portion of the second outwardly extending tab. The depth that each screw is threaded into the respective receiving holes can affect a horizontal angle at which the elongated support member is secured at relative to the wall mount.

BRIEF DESCRIPTION OF THE DRAWINGS

For a more complete understanding of the present invention and further advantages thereof, reference is now made to the following detailed description taken in conjunction with the drawings in which.

DETAILED DESCRIPTION

The present disclosure describes a modular wine bottle holder with the ability to be wall-mounted and facilitate visibility of the bottle labels. The wine bottle holder includes an elongated support member ("bottle support member") selectively interconnected to a wall mount fixed to a wall. The ability to selectively connect the bottle support member to the wall mount can facilitate construction of a wine room/cellar. That is, the wall mounts may be attached to a wall and finish materials may be applied around the wall mounts prior to connection of the bottle support members. For instance, brick may be laid about the wall mounts. Further, the elongated bottle support members can also be interchanged between various wall mounts. The wall mounts can include a socket for receiving an attachment end of the bottle support member. In some embodiments, this socket is arranged such that the horizontal angle of each bottle support member is adjustable to compensate for any misalignment of the wall mount to the wall occurring during installation. Additionally, an illumination element, such as LED's, can be added to the bottle support member in order to provide illumination for each wine bottle. The illuminating element can receive power via electrical connection between the elongated support member and the wall mount and between the wall mount and the wall.

Figure 1A:
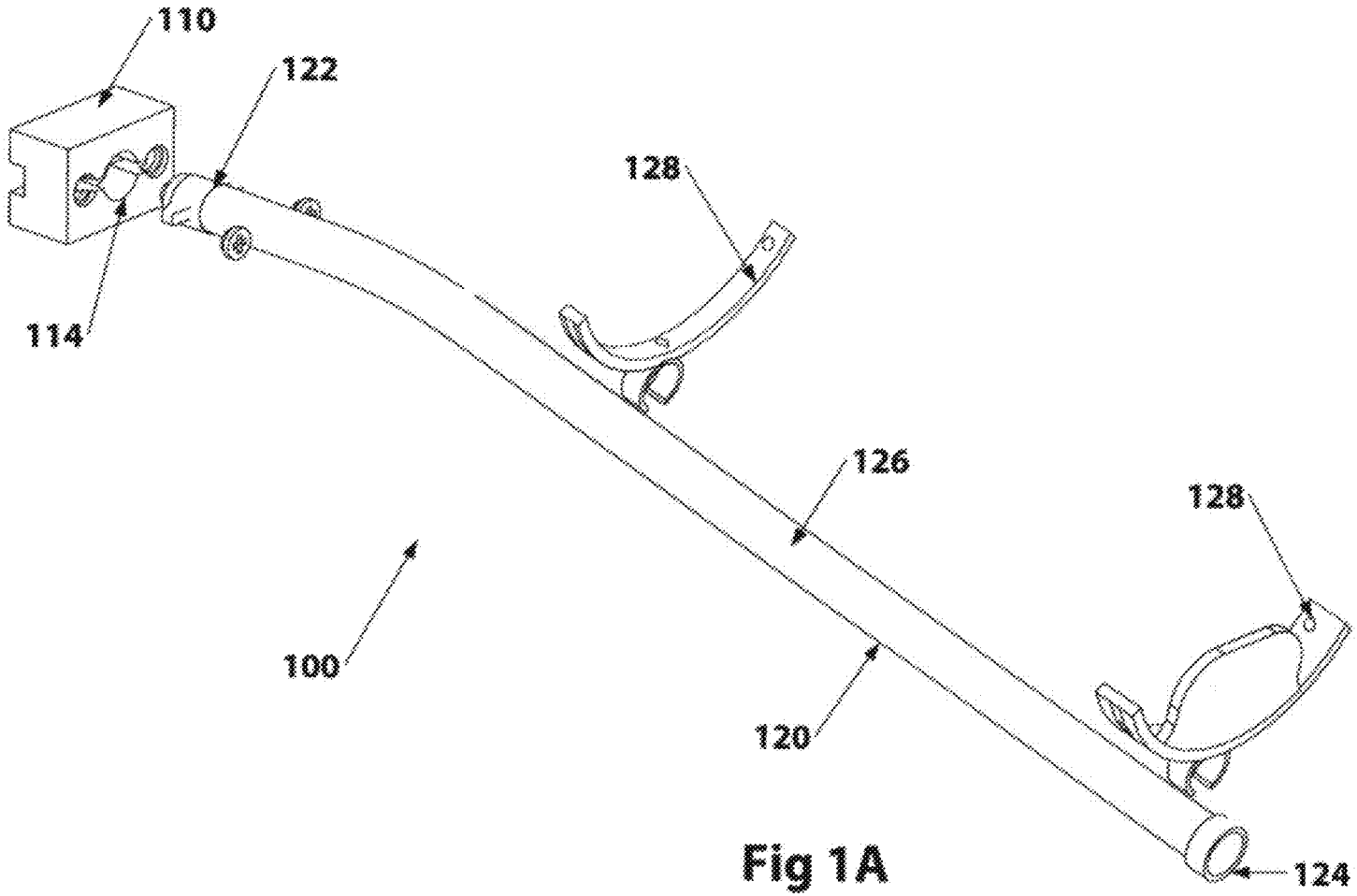
FIGS. 1A and 1B illustrate exploded perspective and side views, respectively, of a wine bottle holder.

FIG. 1A illustrated an exploded perspective view of one embodiment of a wine bottle holder. As shown, the wine bottle holder 100 includes a wall mount 110 and an elongated bottle support member 120. The wall mount 110 is adapted to be affixed to a wall and includes a surface 112 (e.g., front surface) facing away from the wall having a recessed socket 114. The elongated support member 120 includes a free end 122 and an attachment end 124 that is adapted for conformal receipt within at least a portion of the socket 114. An elongated body portion extends between the free end 124 and the attachment end 122 of the bottle support member 120. The body portion 126 includes at least a first cross support 128 for cradling and/or supporting a wine bottle. Generally, the first cross support 128 orients the wine bottle such that a long axis of the wine bottle between its neck and base (or through its neck and base) is substantially aligned with the elongated support member 120. In one embodiment, the axis of the wine bottle is substantially parallel to a reference axis defined by a portion or entirety of the elongated body portion 126.

In the illustrated embodiment, the bottle support member 120 has first and second portions 130, 132 that are angled relative to each other. In such an arrangement, the first portion 130 and the second portion 132 can each have a central axis running through the center thereof, and those axes intersect at a non-zero angle. As illustrated, the two portions 130, 132 can be connected via a curved portion 134. For instance, the body 126 of the bottle support member may be bent between its ends 122, 124. In this arrangement, the second portion may, when the bottle support member is connected to the wall mount, angle downward and includes one or more cross supports 128. The downward angle of the second portion 132 facilitates viewing of the wine bottle and its label in comparison to a bottle displayed horizontally. This is especially true when a wine rack has numerous rows of bottles.

Figure 1B:
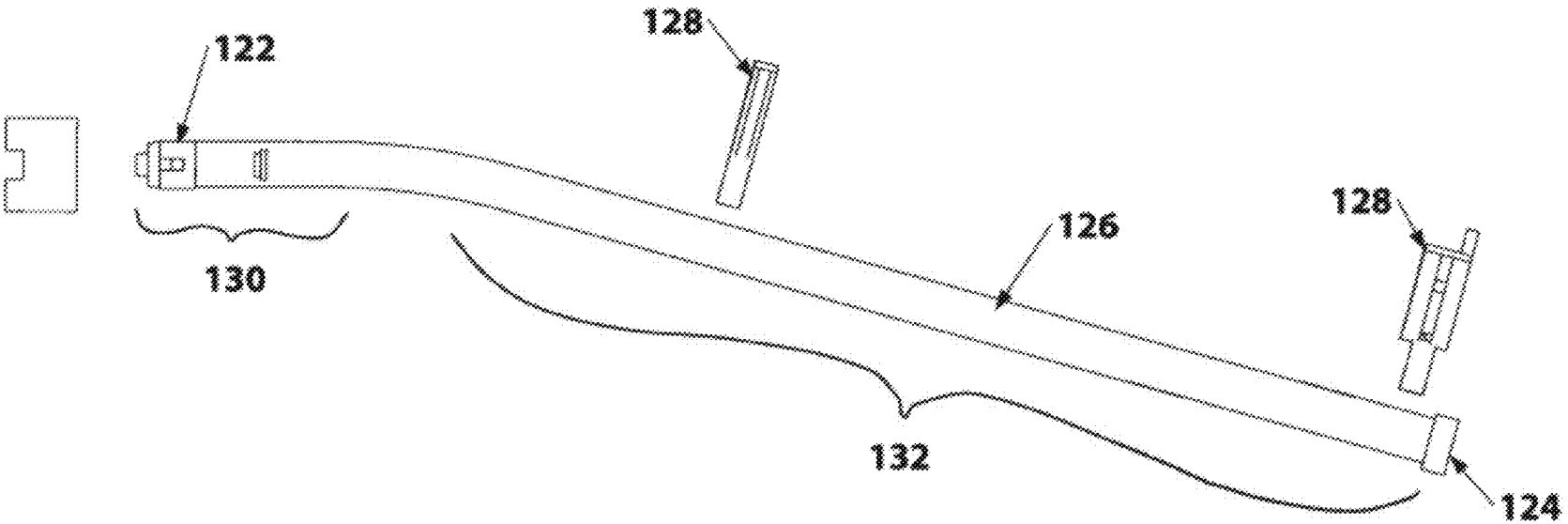
Figure 2:
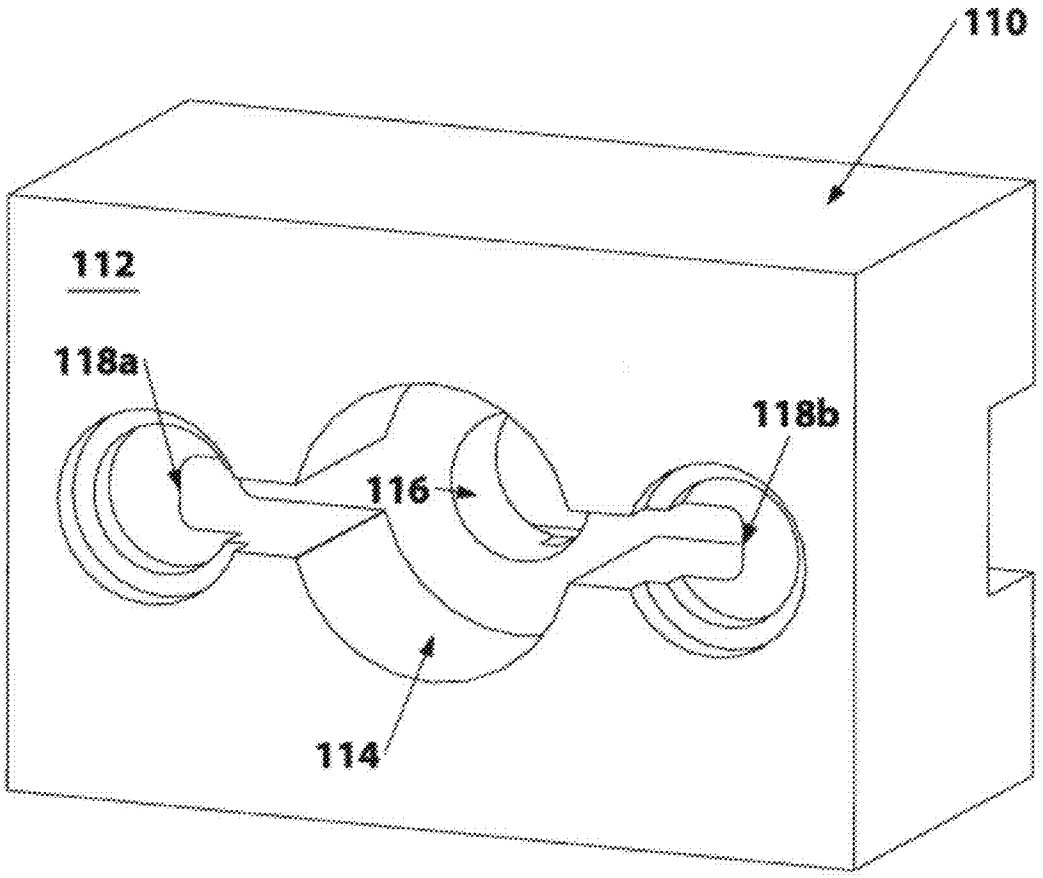
FIG. 2 illustrates a wall mount portion of the wine bottle holder illustrated in FIGS. 1A and 1B.

FIG. 2 illustrates various views of the wall mount illustrated in FIGS. 1A-1B. As noted, the wall mount 110 is adapted for fixed interconnection with a wall. In this regard, the wall mount may be attached to a wall using screws, nails, etc. In any arrangement, once the wall mount 110 is fixed to a wall, the bottle support member may be selectively fixed to the wall via the wall mount 110. In the present embodiment, the bottle support member 120 can be received within the recessed socket 114 formed in a front face 112 of the wall mount 110. This socket 114 includes a central receiving volume shaped to receive the cylindrical end of the elongated support member. The socket 114 can also have additional recesses 118*a*, 118*b* for receiving alignment tabs on the attachment end of the elongated bottle support. In the present embodiment, these additional recesses 118*a*, 118*b* are disposed on opposing sides of the central volume of the socket. However, this need not be the case. Further, the peripheral edges of these recesses 118*a*, 118*b* extending through the front surface of the wall mount 110 are threaded to allow threaded elements (e.g., screws) to be inserted therein. Such screws may be utilized to fixedly connect the elongated support member to the wall mount.

In one embodiment, the wall mount 110 is designed to be at least partially embedded in a wall. For instance, the wall mount 110 can be embedded in a wall such that it is flush with the surface of the wall. The wall could be surfaced using bricks or tiles, such that the wall mount 110 fits snuggly between a plurality of bricks or tiles. In such an embodiment, the wall mount 110 can have a depth that allows it to be flush with a front surface of the brick, tile, or other material pattern that is used to create a wall or a wall façade into which the wall mount 110 is attached. The wall mount 110 can also be partially embedded in the wall such that a portion of the wall mount 110 extends out from the wall.

Figure 3A:
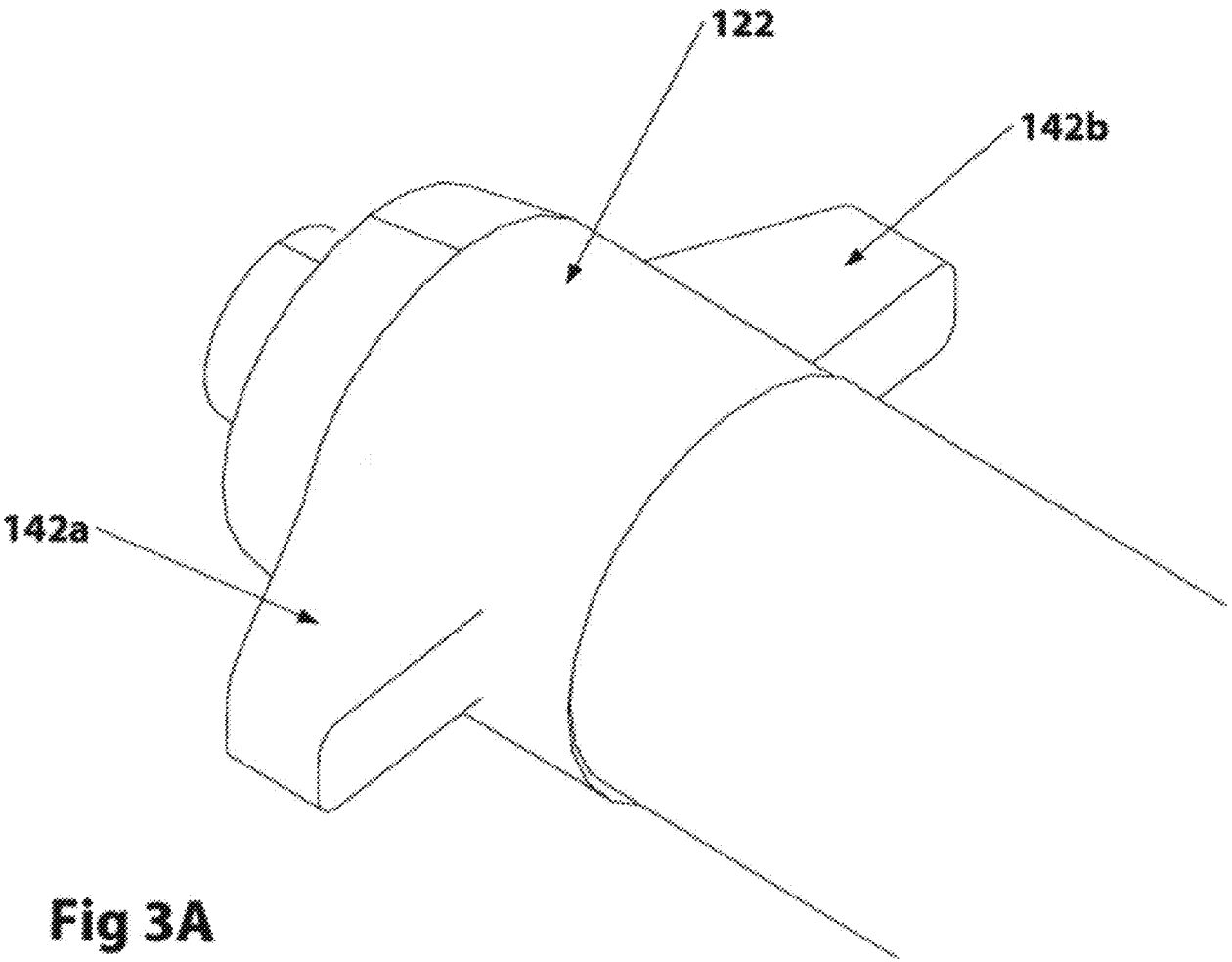
FIG. 3A-3D illustrates various views of the attachment end of the elongated bottle support member illustrated in FIG. 1.
Figure 3B:
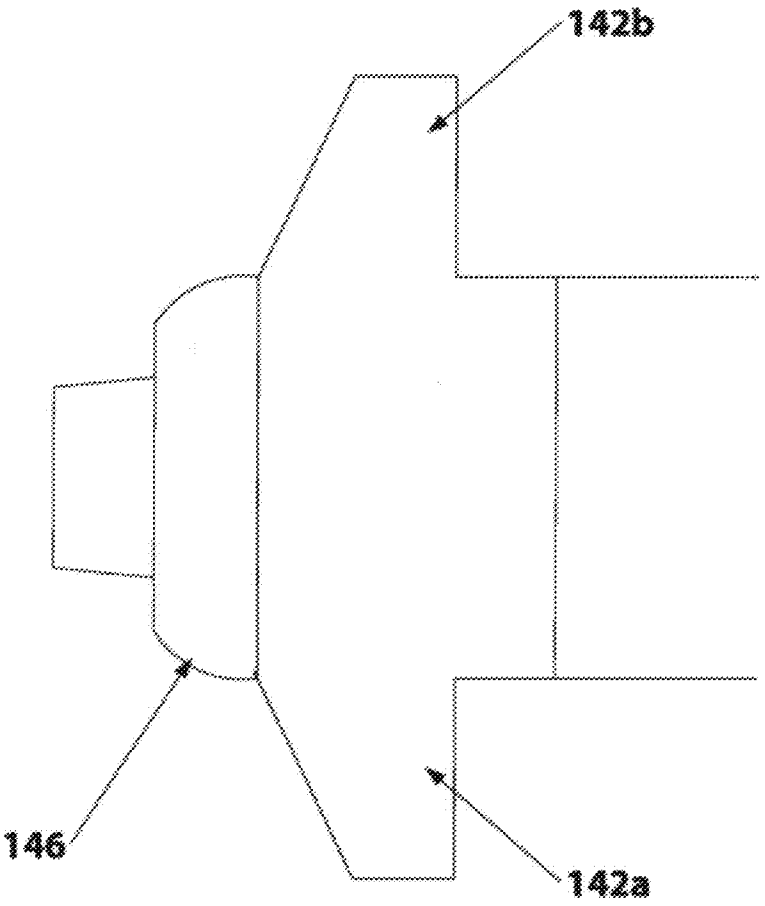
Figure 3C:
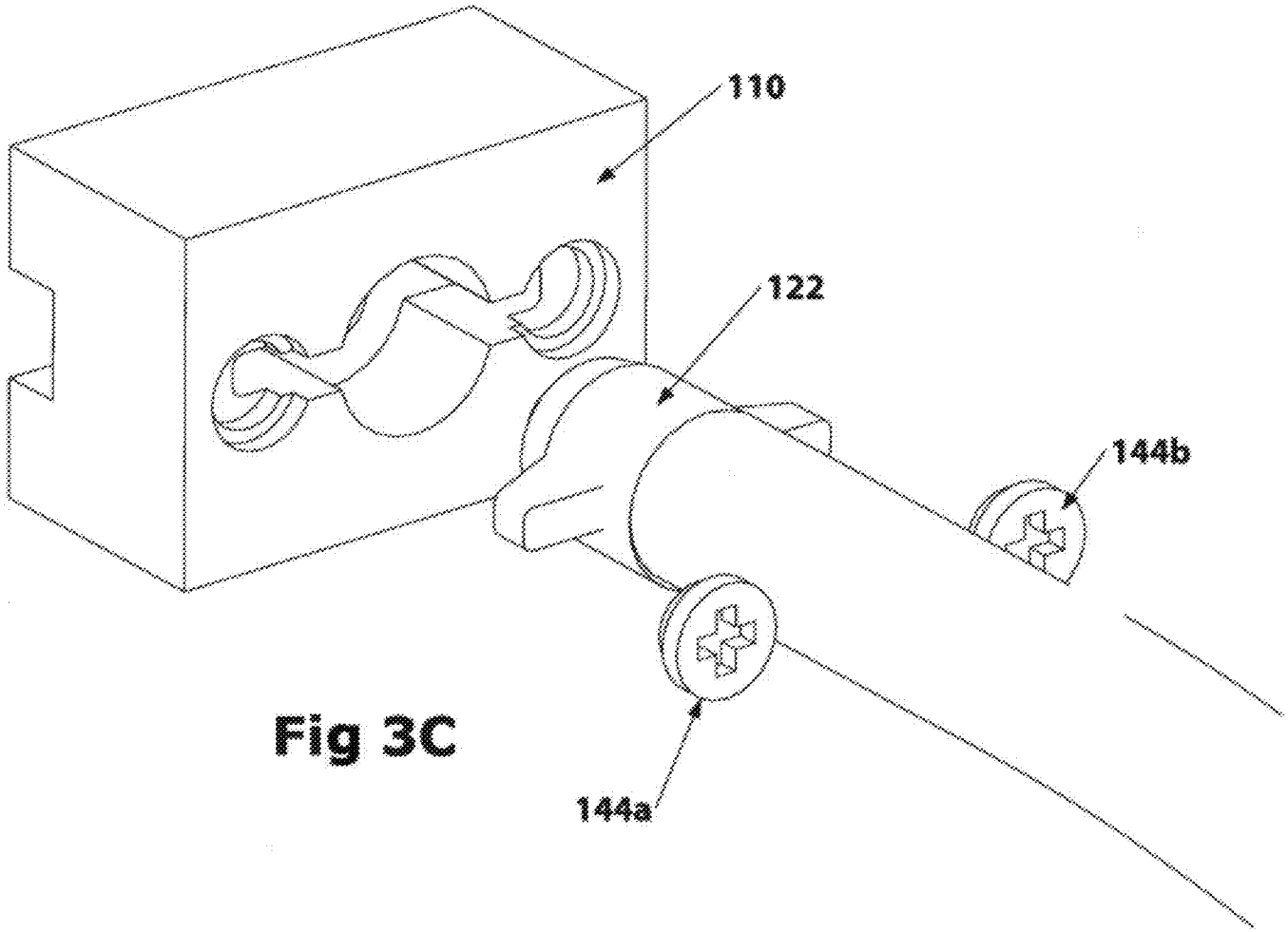
Figure 3D:
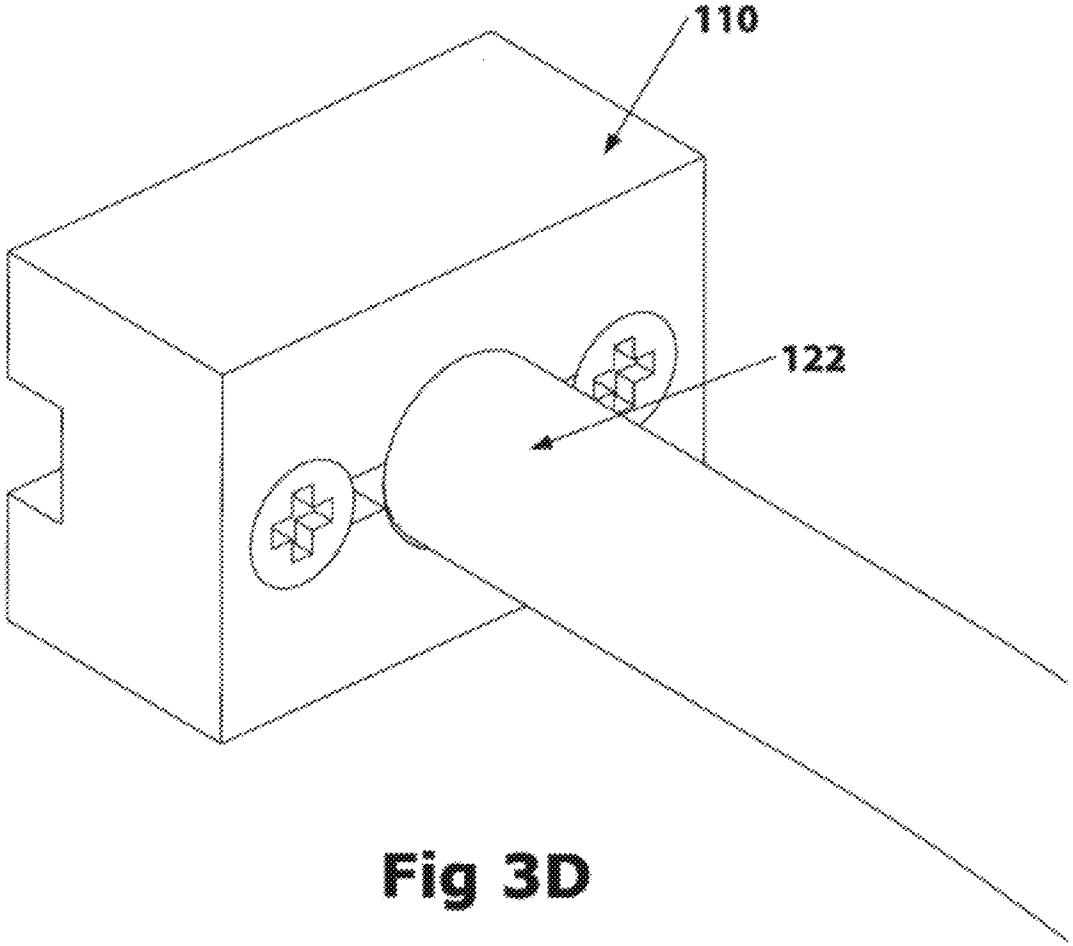

FIGS. 3A, 3B, and 3C illustrate the attachment end of the elongated bottle support member illustrated in FIG. 1. This attachment end 122 is configured for conformal receipt within at least a portion of the socket. In the present embodiment, the attachment end 122 is received entirely within the socket. However, other engagements are possible. In the illustrated embodiment, the elongated support member includes a connection arrangement on the attachment end 122. The connection arrangement is used to maintain the attachment end 122 within the socket of the wall mount. In this particular embodiment, the connection arrangement includes a pair of outwardly extending tabs 142*a*, 142*b* disposed on the attachment end 122. The tabs 142*a*, 142*b* are sized, along with the attachment end 122, for engagement within the socket of the wall mount.

The connection arrangement utilizes first and second threaded elements such as screws to connect the attachment end within the socket 114. These first and second threaded elements are threaded into the threaded peripheries of the tab recess. Once threaded therein, the screws overlay a portion of the tabs in the socket 114. That is, the first and second threaded elements can overlay portions of the socket 114 in which the outwardly extending tabs 142*a*, 142*b* are received. As such, inserting the threaded elements into these threaded recesses secures the tabs within the socket 114.

When the first and second screws 144*a*, 144*b* are screwed into the socket 114 at differing depths, the beveled or rounded end 146 of the connector 140 and/or the sloping front edge of the tabs 142*a*, 142*b* allows altering an angle at which the elongated support member is secured at relative to the wall mount 110. This may be desirable in the event that the wall mount is not installed with perfect alignment to the wall. Hence, if the wall mount 110 is slightly angled relative to the wall, adjusting the screws can realign the elongated support member to be, for example, normal to the wall. The first and second threaded elements can be screwed out of the socket 114 and removed in order to allow the attachment end to be removed from the socket 114. As such, the attachment end is selectively attachable to the socket 114. In other words, the elongated support member can be disengaged from the socket 114 when the first and second threaded elements are removed from the first and second threaded recesses of the socket 114. Although not illustrated, in another embodiment, the attachment end of the connector can be fixed within the socket 114 via a snap ring or similar device. Such an embodiment may not require threaded elements (e.g., screws) to secure the attachment end of the elongated bottle support to the wall mount 110.

Figure 4:
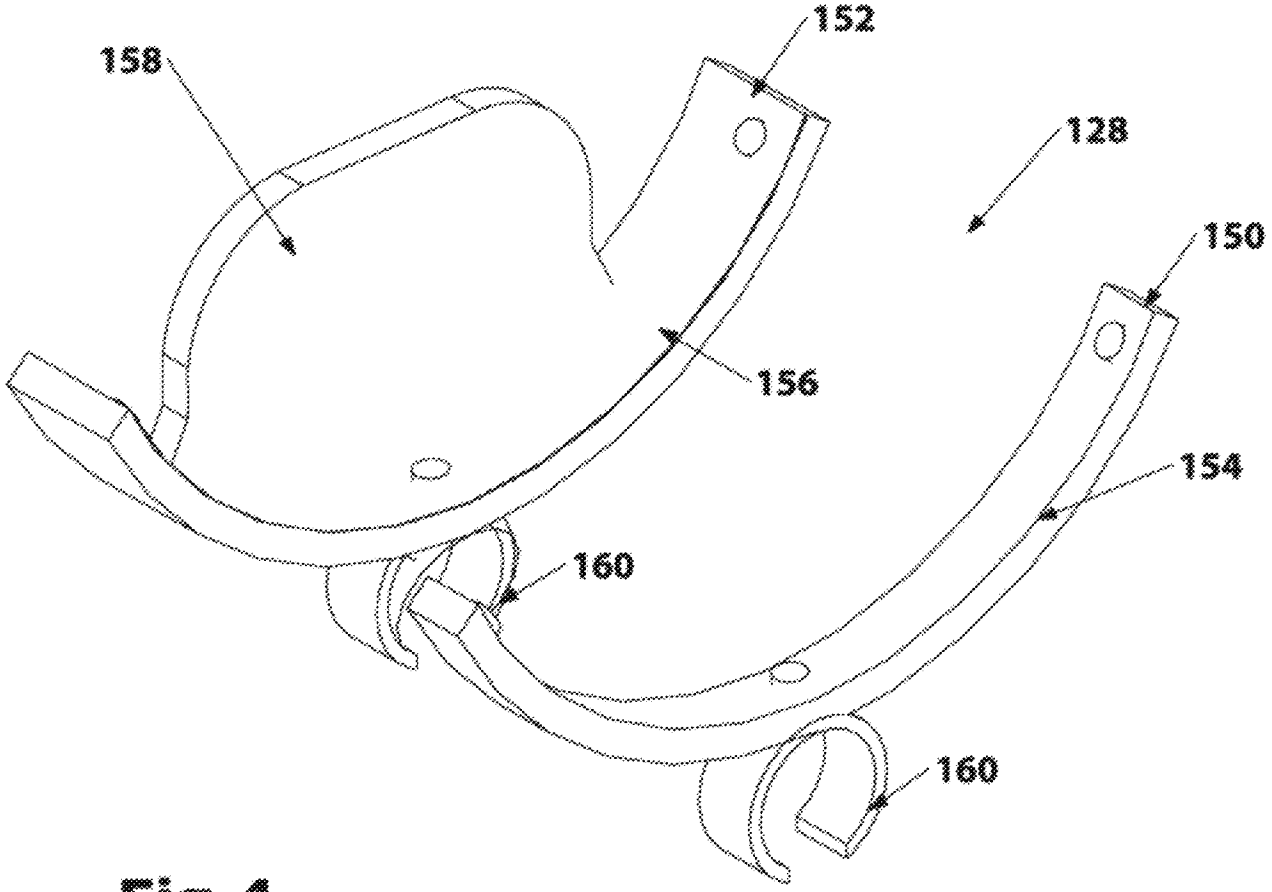
FIG. 4 illustrates one embodiment of a cross support member.

FIG. 4 illustrates one embodiment of the first cross support 128. The first cross support 128 can be connected to the body portion of the elongated bottle support member. In this particular embodiment, the cross support 128 includes first and second recessed elements 150, 152 having recessed upper surfaces 154, 156 sized to support or cradle a wine bottle. Connecting the recessed cross support elements to the body of the bottle support member 120 allows for supporting a wine bottle in substantial alignment with the long axis of the body 126 extending between the attachment end 122 and the free end 124 of the bottle support member 120. In this embodiment, the recessed support elements 150, 152 can be releaseably connected to the elongated support member via a snap fit arrangement. The snap fit can be made possible via a c-shaped ring element 160. The c-shaped attachment element 160 is flexible to allow expansion and contraction as the c-shaped attachment element 160 is forced over the body elongated support member. Other means of attaching the first support 128 to the elongated support member are also possible. In the present embodiment, the second recessed element 152 includes an end stop 158. Accordingly, the first recessed element 150 supports either the neck of the wine bottle or a portion of the wine bottle body adjacent to the neck and the second recessed element 152 supports the bottom or base of the wine bottle. In this regard, the base of a bottle abuts the end stop 158 thus preventing the wine bottle from sliding off the elongated support 120.

Figure 5:
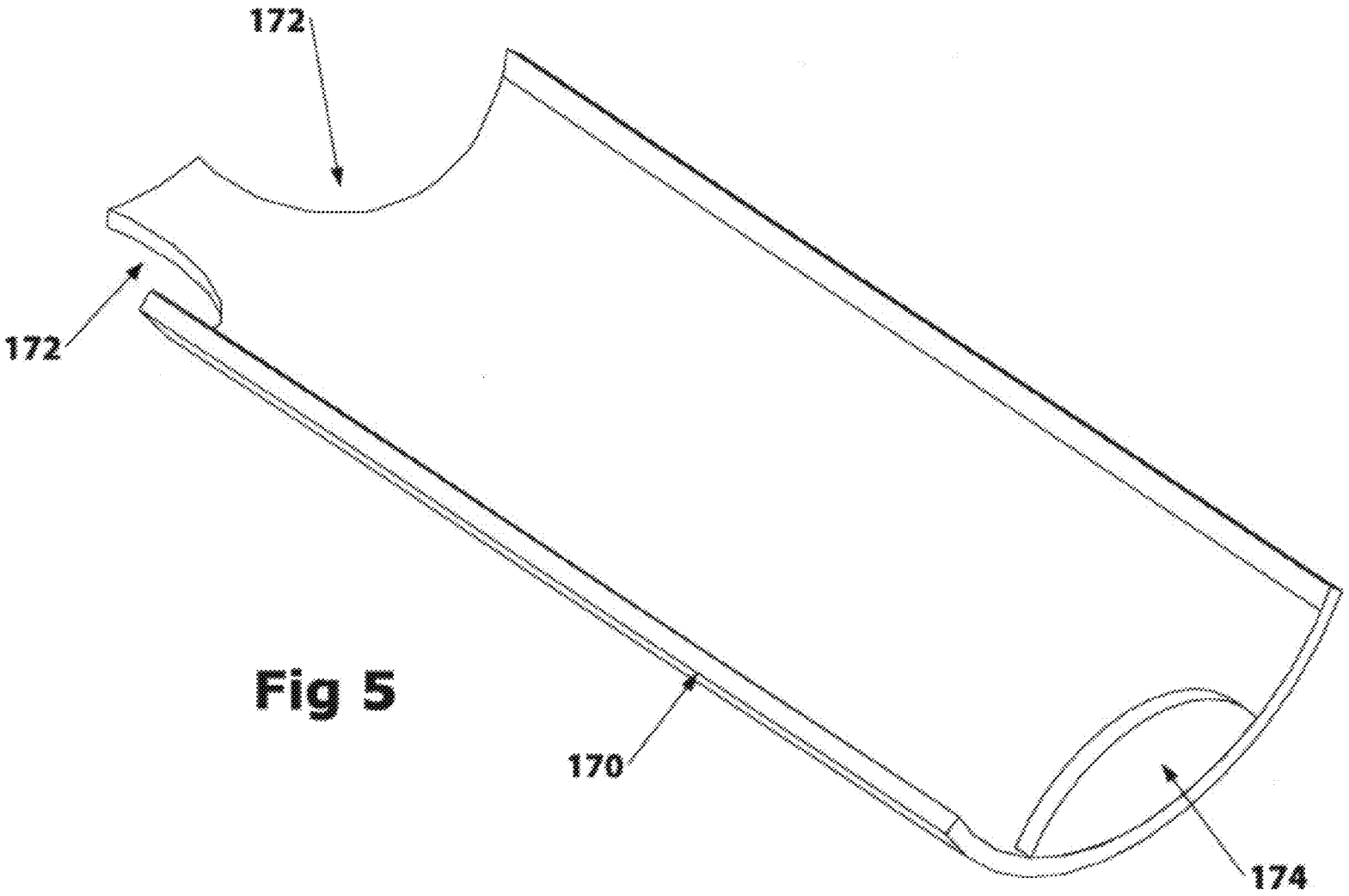
FIG. 5 illustrates another embodiment of a cross support member.

FIG. 5 illustrates another embodiment of a recessed cross support element 170. In the illustrated embodiment, the first recessed element 170 is shaped like a portion of a cylinder. Such a shape prevents the wine bottle from moving sideways or from sliding towards the ground. Such a shape may also be described as comprising less than half of a cylinder. The portion of the recessed element closest to the wall and thus proximal to the neck of the wine bottle includes arcuate cutouts 172 that may assist in removal of the wine bottle from the recessed element 170. A lower end of the recessed element includes a stop 174 to support the base of a wine bottle. This recessed support element may attach to the elongated support member in a manner similar or identical to that discussed above in relation to FIG. 4.

Figure 6:
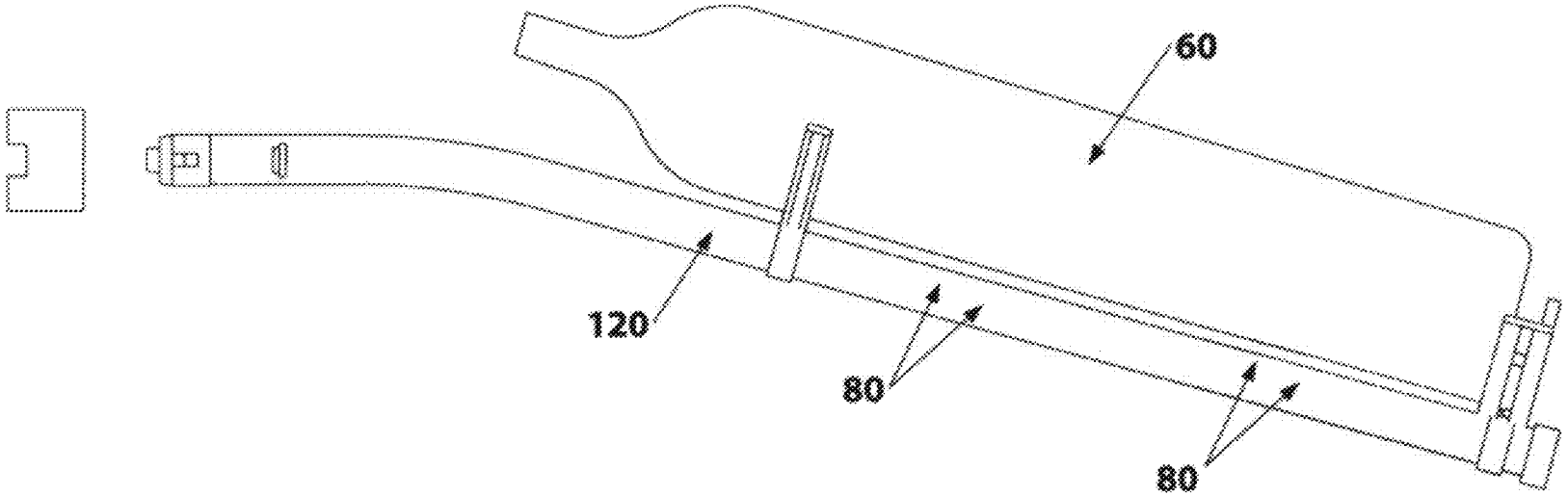
FIG. 6 illustrates an elongated bottle support member including illuminating elements.

FIG. 6 illustrates a side view of an embodiment of the wine bottle holder having illuminating elements for illuminating a portion of a wine bottle. The illuminating elements 80 can be connected to the elongated support member 120 at a location between the free end 124 and the attachment end 122. The illuminating element(s) 80 can illuminate the wine bottle 60 being held by the elongated support member 120. For instance, in the illustrated embodiment, the wine bottle 60 is illuminated from below by the illuminating elements 80 positioned on a top of or within the elongated support member 120. Alternately and/or additionally, the illuminating elements 80 can illuminate below the elongated support to illuminate a wine bottle (not illustrated) on a bottle support below the illustrated support.

Each illuminating element(s) 80 may include multiple illuminating elements. For instance, there could be four illuminating elements including two positioned on the top of the bottle support element 120 and two positioned on the bottom of the bottle support element. In other embodiments, the number of illuminating elements on the top and bottom may not be equal. Further, the elongated support member 120 and/or cross support elements can be partially or wholly made from a translucent or transparent material thus allowing the pair of illuminating elements 832 to illuminate the wine bottle 810 despite the light passing through at least a portion of the elongated support member or cross support. In one embodiment, the illuminating elements are light emitting diodes (LED's). In order to provide electrical panes in embodiments providing illuminating elements, the wall mount must be connected to an electrical power source. Further, the elongated support member must also be connectable to the power source. In one embodiment, attachment of the connector end 124 with the wall mount 110 electrically connects mating electrical contacts on these elements.

Figure 7:
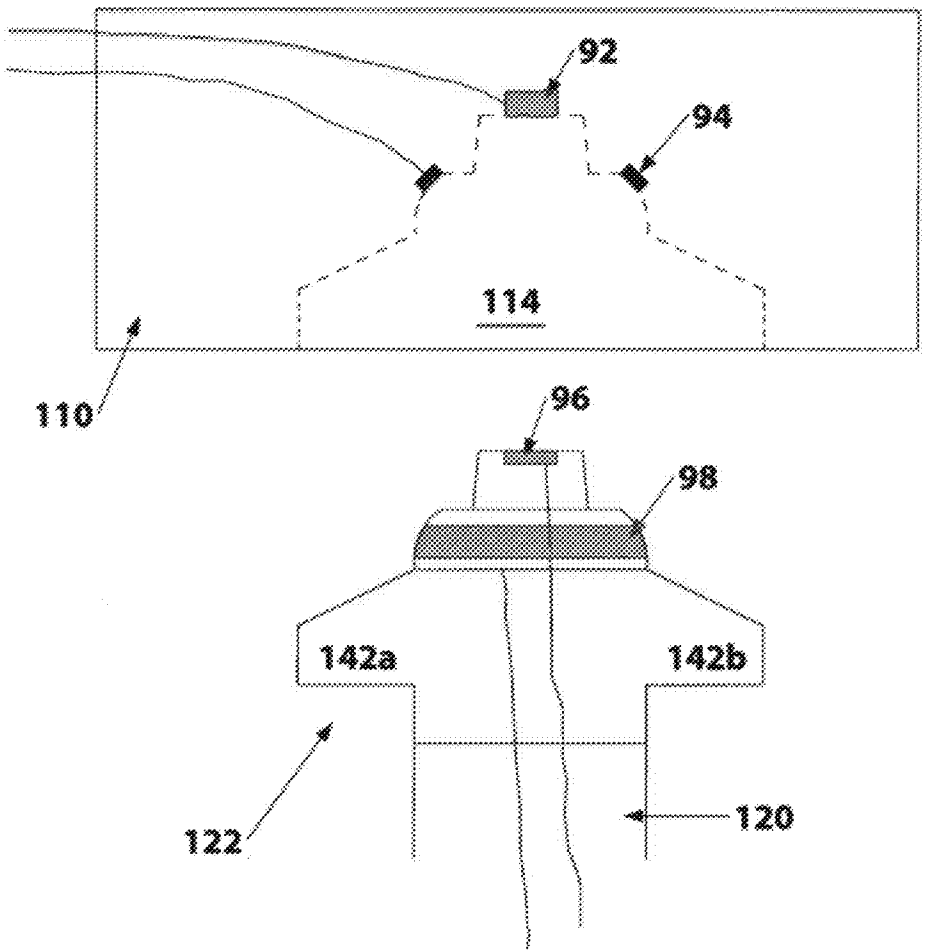
FIG. 7 illustrates an overhead view of the attachment end of the elongated support member and the wall mount showing the position of optional electrical contacts.

FIG. 7 illustrates an overhead view of the attachment end 124 of the elongated support member 120 and the wall mount 110 showing the position of such electrical contacts. Once connected, the illuminating element can be powered via electrical connection through the wall mount 110 and through to the wall. As shown, the socket 114 includes first and second electrical contact 92, 94. In the present embodiment, the first contact is a tip electrode 92 and the second contact is a ring electrode 94. Likewise, the attachment end 124 includes third and fourth electrical contacts 96, 98. Specifically a tip electrode 96 and a ring electrode 98. When the attachment end 124 is inserted into the socket 144, the first and second electrical contacts 92, 94 of the socket 114 and the third and fourth electrical contacts 96, 98 of the attachment end 124 come into contact and provide an electrical connection between the wall and the illuminating element. The electrical connections can include more or less than two connectors (e.g., three prong connectors and one prong connectors, to name two). However, the electrical connections between the elongated support member and the wall mount are not permanent, thus allowing the elongated support member to be removed from the wall mount. The electrical connections between the wall mount 110 and the power source can be temporary (e.g., metal on metal contacts) or permanent (e.g., soldered).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

What is claimed:

1. A wine bottle holder comprising:

a wall mount adapted for fixed interconnection to a wall, said wall mount having a surface with a recessed socket formed therein having a first electrical contact and a second electrical contact;

an elongated support member having a long axis including:

an attachment end, wherein said attachment end is configured for conformal receipt within at least a portion of the socket and includes a first mating electrical contact and a second mating electrical contact, wherein said elongated support member is cantilevered from said wall mount when disposed in said recessed socket;

a free end, wherein a body portion of the elongated support member extends between the attachment end and the free end;

at least a first support disposed on an upper surface of said elongated support member having a recessed top surface and a bottle stop on a lower portion, wherein said first support is adapted to cradle and support a wine bottle such that an axis of the wine bottle between its neck and base is substantially aligned with said long axis of the elongated support member; and an illuminating element supported by said elongated support member, wherein the illuminating element receives electrical power from the wall mount when the attachment end is disposed within the socket, wherein said illuminating element illuminates an area below said elongated support member.

2. The wine bottle holder of claim 1, further comprising a connector for selectively maintaining the attachment end within the socket.

3. The wine bottle holder of claim 2, wherein the connector further comprises first and second screws.

4. The wine bottle holder of claim 3, wherein the first support of the elongated support member further comprises a bottle support element releaseably connected thereto.

5. The wine bottle holder of claim 4, wherein the bottle support element has a recessed surface for supporting the bottle.

6. The wine bottle holder of claim 1, wherein the attachment end includes first and second tabs.

7. The wine bottle holder of claim 1, wherein the elongated support member comprises a first portion and a second portion, and wherein the first portion and the second portion are angled relative to each other.

8. The wine bottle holder of claim 1, wherein the wall mount is at least partially embedded in a wall.

* * * * *